US008757115B2

(12) United States Patent
Schober

(10) Patent No.: US 8,757,115 B2
(45) Date of Patent: Jun. 24, 2014

(54) CAMSHAFT ADJUSTER WITH DEVICE FOR EMERGENCY OPERATION

(75) Inventor: Michael Schober, Behamberg (AT)

(73) Assignee: MAGNA Powertrain & AG & Co. KG, Lannach (AT)

( * ) Notice: Subject to any disclaimer, the term of this patent is extended or adjusted under 35 U.S.C. 154(b) by 133 days.

(21) Appl. No.: 13/461,830

(22) Filed: May 2, 2012

(65) Prior Publication Data

US 2012/0279466 A1 Nov. 8, 2012

Related U.S. Application Data

(60) Provisional application No. 61/481,339, filed on May 2, 2011.

(51) Int. Cl.
*F01L 1/34* (2006.01)

(52) U.S. Cl.
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS 7,597,075 B2 * 10/2009 Schafer et al. ..... 123/90.17

FOREIGN PATENT DOCUMENTS

| | | | |
|---|---|---|---|
| JP | 10-018815 | A | 1/1998 |
| JP | 2005-525495 | A | 8/2005 |
| JP | 2008-506070 | A | 2/2008 |
| JP | 2008-512598 | A | 4/2008 |
| JP | 2009-503344 | A | 1/2009 |
| JP | 2009-162109 | A | 7/2009 |
| JP | 2010-223016 | A | 10/2010 |
| JP | 2011-052563 | A | 3/2011 |

* cited by examiner

*Primary Examiner* — Zelalem Eshete
(74) *Attorney, Agent, or Firm* — Jordan IP Law, LLC; Todd A. Vaughn

(57) ABSTRACT

An adjustment device for adjusting the relative angular position of a camshaft with respect to a crankshaft within a specified angle range, the adjustment device having a device for emergency operation of the adjustment device. The device for emergency operation includes a freewheel device which can be activated in an emergency mode of the adjustment device and, in an activated state, is able to allow an adjustment movement of the camshaft with respect to the crankshaft from the current position in a first direction towards an emergency running position and to block an adjustment movement in a second direction opposite thereto.

18 Claims, 4 Drawing Sheets

CAMSHAFT ADJUSTER WITH DEVICE FOR EMERGENCY OPERATION

CROSS-REFERENCE TO RELATED APPLICATIONS

The present application claims priority under 35 U.S.C. §119 to U.S. Provisional Patent Application No. 61/481,339 (filed on May 2, 2011), which is hereby incorporated by reference in its entirety.

FIELD OF THE INVENTION

The present invention relates to an adjustment device for adjusting the relative angular position of a camshaft with respect to a crankshaft within a specified adjustment angle range.

BACKGROUND OF THE INVENTION

In an emergency, such as, for example, if faults occur in the electronics, the sensors or the actuators, adjustment devices or camshaft adjusters of this kind must bring the camshaft into a defined emergency running position (e.g., fail-safe position) to ensure that the internal combustion engine can continue to operate at least with limitations. In particular, the emergency running position can be chosen so that the internal combustion engine can also be started in this position.

Usually, i.e., in normal operation of the internal combustion engine, the camshaft is moved under control to its basic or emergency running position (for example, with the help of an adjustment motor) when the internal combustion engine is switched off, i.e., as a rule the "late" position in the case of an inlet camshaft or the "early" position in the case of an exhaust camshaft. If, however, the internal combustion engine stalls or the electronics (e.g., the adjustment motor) fails, the camshaft can be in an undefined position away from the emergency running position, which can lead to problems when the internal combustion engine is restarted.

Devices for adjusting the camshaft of an internal combustion engine are normally in the form of an adjustment gearbox, in particular a three-shaft gearbox, which, for example, has an input drive shaft connected to the crankshaft, an output drive shaft connected to the camshaft and an adjustment shaft connected to an electric adjustment motor.

An electromechanical phase adjuster for adjusting the phase position of a camshaft relative to a crankshaft of an internal combustion engine, with which the range of possible phase positions (adjustment angle range) of the camshaft is limited by two end stops, the so-called late end stop and the so-called early end stop, is disclosed in document WO 2005/008034.

In an embodiment, these two end stops are connected to a rotating disc of the gearbox which is connected to the camshaft gear and interact with a stop which is located on the gearbox output side on a rotating disc of the gearbox which is connected to the camshaft.

The gearbox of the electromechanical phase adjuster is not self-locking, i.e., a torque at its gearbox input side causes a rotation at its gearbox output side and vice versa.

Furthermore, the adjustment gearbox has a negative rotational transmission ratio, i.e., the direction of rotation at the gearbox input side associated with the adjustment drive is opposite to that at the gearbox output side. As a result of this, a retardation of the gearbox input side effects an adjustment of the gearbox output side in the "early" direction. If this fails, then a locking device causes the camshaft to move into a specified emergency running position. Depending on the design, the stop which is arranged on the camshaft or the two end stops which limit the adjustment angle range is/are designed to be movable for this purpose. For the purpose of repositioning, a pre-tensioned spring, which in normal operation is held in its pre-tensioned position by means of a latching mechanism, is provided on the stop to be moved. As a result of activating an unlocking mechanism of the locking device, the latching mechanism is released so that, due to its pre-tensioning, the spring can move the associated stop.

A blocking mechanism, which is likewise associated with the stop to be moved, prevents it moving in a direction which opposes the spring pre-tensioning. In an emergency situation in which the electric adjustment drive has failed, the unlocking mechanism, therefore, unlocks the latching mechanism so that the stop of the camshaft is brought into contact with the end stop of the input drive gear. The blocking mechanism prevents the possibility of the camshaft moving in opposition to the end stop which is in contact therewith.

When the phase adjustment direction is subsequently changed again, the first end stop or the stop which rests against the end stop is moved towards its emergency running position until it reaches this position. In the emergency running position, the second end stop also rests against the stop, and thus, locks the phase adjustment device in its emergency running position.

In accordance with this embodiment, a freely definable mid-position (position within the adjustment range) can be chosen as the emergency running position (fail-safe position). It is not disclosed, however, how the actuators used can leave the emergency running operating state (fail-safe mode) in order to change over to normal operation. This is, however, particularly important when, for example, it transpires that the emergency running mode has only been initiated as a result of a plausibility problem or a temporary fault.

Furthermore, a device for releasably connecting and adjusting the camshaft and the crankshaft of an internal combustion engine is disclosed in WO 03/095803 A1. Here, the emergency running position of the camshaft is achieved by rotating the drive shaft, which is connected to the crankshaft, and by a suitable stationary gear ratio. In this embodiment, the emergency running position is therefore achieved in that contact is made with a mechanical end stop. The emergency running position therefore corresponds to the maximum early or late setting on the respective early end stop or late end stop of the camshaft.

It can, however, transpire that the camshaft does not achieve its final emergency running position, especially when the adjustment motor produces a braking torque when it ails or when an actuating electronic device fails. Furthermore, a reliable positioning of the camshaft is not guaranteed, thus enabling it to leave its emergency running position, possibly in an uncontrolled manner. This can occur particularly as a result of the inertia-induced torques through the adjustment motor which the internal combustion engine produces at the gearbox input of the adjustment gearbox when accelerating or braking, or when strongly alternating torques act on the camshaft.

Furthermore, DE 10 2004 061 710 A1 discloses a camshaft adjustment device which, in an emergency, can be locked with the help of a locking element for locking a component fixed to the camshaft to a component fixed to the crankshaft.

Furthermore, an electric camshaft adjuster, in which a pre-tensioned spring pushes the camshaft adjuster back into an appropriate end position (maximum early position or maximum late position of the camshaft), is disclosed in WO 2011/104051 A1. The disadvantage of such an embodiment can be that the spring is not only active in emergency mode, but also positively acts on the camshaft over the whole adjustment range thereof, which may have a negative effect with regard to its energy consumption. If the spring force of this adjustment spring is chosen to be smaller, then there is a risk that its adjustment force is not sufficient to move the camshaft into the required end position in an emergency. Moreover, with this embodiment too, the camshaft can be moved out of its emergency running position in an uncontrolled manner in the event of particularly high strongly alternating torques.

Finally, DE 10 2004 033 522 A1 discloses a cam adjuster with electric drive, in which the adjustment device for adjusting the relative angular position of the camshaft with respect to the crankshaft has an adjustment drive as primary adjustment device and an auxiliary drive as secondary adjustment device. If the adjustment motor fails, the camshaft can be moved into a fixed angular position, the so-called emergency running position, by means of the auxiliary drive. A possible design of such an auxiliary drive includes a torsion spring which is pre-tensioned in a basic position by a displacement of the angle of rotation between the drive gear of the camshaft and part of the adjustment gearbox which is fixed to the camshaft and, in the event of a failure of the adjustment motor, effects a resetting by releasing the tension.

The disadvantage of this embodiment, however, is the costs associated with providing such an auxiliary drive. Further, the auxiliary drive requires a not insignificantly large proportion of the available installation space, which can likewise be seen as a disadvantage.

SUMMARY OF THE INVENTION

On the other hand, an object of the present invention is providing an adjustment device for adjusting the relative angular position of a camshaft with respect to a crankshaft, with which the disadvantages that have become known from the prior art can be at least partially reduced.

In accordance with the present invention, an adjustment device configured to adjust the relative angular position of a camshaft with respect to a crankshaft within a predetermined angle range, the adjustment device including at least one of the following: an emergency device including a freewheel device configured for activation in an emergency mode of the adjustment device to permit an adjustment movement of the camshaft with respect to the crankshaft from a first position in a first direction towards a second, emergency running position and to block an adjustment movement in a second direction opposite thereto, the emergency device including a locking device configured to lock the adjustment device when the camshaft has reached an emergency running position relative to the crankshaft and an actuator configured to activate the freewheel device.

In accordance with the present invention, an adjustment device configured to adjust the relative angular position of a camshaft with respect to a crankshaft within a predetermined angle range, the adjustment device including at least one of the following: an emergency device including a freewheel device configured for activation in an emergency mode of the adjustment device to permit an adjustment movement of the camshaft with respect to the crankshaft from a first position in a first direction towards a second, emergency running position and to block an adjustment movement in a second direction opposite thereto, the emergency device including a locking device configured to lock the adjustment device when the camshaft has reached an emergency running position relative to the crankshaft and an actuator configured to activate the freewheel device.

The adjustment device can be in the form of an adjustment gearbox, in particular a three-shaft gearbox, which is configured to adjust the relative angular position of the camshaft of an internal combustion engine with respect to its crankshaft. The device for emergency operation of the adjustment device (emergency running device) can, for example, be designed in the form of a switchable freewheel device which is not active in normal operation and is activated in emergency running mode. In its activated state, the freewheel device is designed to permit movement of the camshaft relative to the crankshaft in only one direction and to block it in the opposite direction. Furthermore, the movement of the camshaft in the one direction is permitted until an end stop or a predetermined emergency running position of the camshaft is reached.

When the device for emergency operation of the adjustment device is activated, the input drive of a camshaft drive gear (e.g., in the form of a chain wheel) with a non-uniform speed is used to move the camshaft into its emergency running position.

Furthermore, it can be provided that the freewheel device is securely connected to the camshaft.

Furthermore, the freewheel device can have an interlocking and/or frictional connection to a part of the adjustment device which rotates relative to the camshaft in order to block an adjustment movement of the camshaft with respect to the crankshaft in the second direction.

Here, an interlocking connection is understood to mean a connection in which one connection partner prevents the movement of the other connection partner, at least in one direction of movement, by resting against it. Furthermore, a connection is a frictional connection when the connection partners are connected to one another by static friction.

The freewheel device of the adjustment device in accordance with embodiments can include a spring pre-tensioned pawl which is designed to engage in an interlocking manner in a gear element of the adjustment device which is designed in the form of an adjustment gearbox.

The freewheel device preferably acts between an input drive gear or the gearbox output of an adjustment device, which is designed in the form of an adjustment gearbox, and a further gearbox part. The further gearbox part can be an element of the gearbox with a higher ratio, such as the gearbox input gear or a planet gear, for example. This enables the necessary forces which the freewheel device has to provide for the operation of the emergency running device to be significantly reduced so that, if necessary, the freewheel device can also be made of plastic.

Furthermore, in order to activate the device for emergency operation (emergency running device), the adjustment device in accordance with embodiments can include an actuator for activating the freewheel device. In particular, the actuator can include an end limit switch which is arranged outside the adjustment angle range of the camshaft relative to the crankshaft in normal operation of the adjustment device. This activates the emergency running device by reaching a defined phase angle of the camshaft which lies outside the angular range used in normal operation of the internal combustion engine. For example, the actuator can be provided at that end of the adjustment range towards which the adjustment device typically moves (when the adjustment motor fails).

In addition to the actuator, a mechanical end stop, which is arranged at this end of the adjustment range to further safeguard the adjustment range, can also be provided in accordance with embodiments.

Consequently, in such an embodiment, the emergency running device can be activated at one end of the adjustment range. The freewheel device then moves the camshaft away from this end towards the other end of the adjustment range until an emergency running position of the camshaft or the other end stop is reached.

Furthermore, the device for emergency operation of the adjustment device (emergency running device) in accordance with embodiments can include a locking device configured to lock the adjustment device when the camshaft has reached its emergency running position relative to the crankshaft. The locking device therefore constitutes a blocking device or inhibiting device which, on reaching a particular predefined adjustment angle of the camshaft, locks the adjustment gearbox or adjustment device and inhibits further adjustment at least up to a pre-specified torque. For example, such a torque can be rated so that this torque is not reached when an adjustment motor is de-energized and therefore the adjustment device remains in this position during further operation (emergency running mode) of the internal combustion engine. On the other hand, when the adjustment motor is activated once more, the pre-specified torque can be exceeded thereby, so that with the help of the adjustment motor the camshaft can be moved beyond this angular position in the direction allowed by the freewheel device until the appropriate end stop is reached.

Furthermore, the locking device in accordance with embodiments can also have a different behavior in its activated state depending on the speed or depending on the direction. In particular, the locking device can be designed so that, at a camshaft speed which is less than a specified threshold value, it releases the adjustment device on reaching the respective phase angle of the adjustment device, and, above a camshaft speed which is greater than the threshold value, it blocks the adjustment device. Also, the torque necessary for further movement of the adjustment device (the threshold value) can become smaller or larger or approximately zero with increasing camshaft speed due to the activated locking device. Such a speed dependency can be achieved particularly easily by utilizing the speed-dependent centrifugal force which acts on the parts attached to the adjustment device.

Furthermore, the locking device in accordance with embodiments can include a locking bolt which is set up to act between the input drive gear of the camshaft and a part which is fixed to the camshaft.

Furthermore, the locking device in accordance with embodiments can include an elastic element, in particular a leaf spring, which is able to pre-tension the locking bolt in the direction of its locking position.

Basically, both the freewheel device and the locking device can be deactivated once more by an appropriate actuator. For example, this can be the same actuator which activates the freewheel device and/or the locking device. Alternatively however, it can also be a different actuator, i.e. a first actuator can be provided for activating the freewheel device and/or the locking device, and a second actuator can be provided for deactivating the freewheel device and/or the locking device.

Alternatively, instead of an (active) actuator for deactivating the freewheel device and/or the locking device, resetting or deactivation can also be effected on reaching an end stop, so that the adjustment device works in normal operation once more when this end stop has been reached.

It can be provided that the freewheel device and the locking device in accordance with embodiments are designed integrally with one another. In such a case, a single component, in which the two functions of freewheel device and locking device are incorporated, is provided.

Accordingly, it can also be provided that the actuator is provided for activating both the freewheel device and the locking device and for deactivating both the freewheel device and the locking device.

Regardless of the type of activation of the freewheel device, it can also be provided that this is activated and deactivated depending on the speed.

In accordance with embodiments, advantageously, the freewheel device also includes a rocker arm to which a pawl of the freewheel device is attached in such a way that it can swivel. The rocker arm can be mounted rotatably or pliably in a pivot point on the base plate or on the input drive gear of the adjustment device and then oscillate or pivot about this pivot point when it is unlocked. One or more spring elements, which are designed to hold the rocker arm in a nominal position (zero position) about which the rocker arm can oscillate, can also be provided. For example, the spring elements can be in the form of springs and be supported on the base plate or input drive gear of the adjustment device.

At a particular camshaft speed or a particular frequency excitation of the speed non-uniformity of the camshaft drive, and when the rocker arm is unlocked, the arm oscillates to an increasing extent about its nominal position until the attached pawl turns the gearbox input gear wheel, for example, further by one tooth. In doing so, the spring elements serve to match the inertia of the rocker arm for a required resonant frequency.

This is advantageous particularly when a movement of the adjustment drive or of the adjustment device towards the emergency running position is not possible without such a rocker arm, as driving the gearbox input gear wheel, for example, would require too great a force.

The freewheel device in accordance with embodiments can also include a further pawl which is suitable for engaging in an interlocking manner in a gear element of the adjustment gearbox of the adjustment device.

Alternatively or additionally to the rocker arm described above, a linearly moved oscillator can be used, the mass of which likewise oscillates in a substantially tangential direction when the adjustment gearbox is activated.

BRIEF DESCRIPTION OF THE DRAWINGS

Embodiments of the invention is described below with reference to the attached figures which show embodiments of the invention by way of example. Schematically, in the drawings.

DETAILED DESCRIPTION OF EMBODIMENTS

Figure 1:
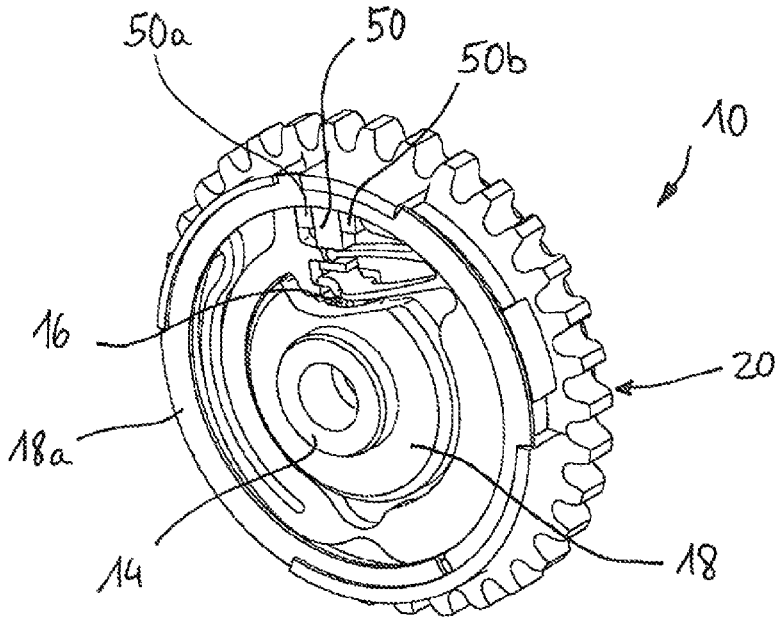
FIG. 1 illustrates an isometric view of an adjustment device in accordance with embodiments.

FIGS. 1 to 4 illustrate an adjustment device in accordance with a first embodiment of the invention which is designated in general by the reference 10. The adjustment device 10 is in the form of a three-shaft gearbox including a chain wheel 12 which corresponds to a camshaft input drive gear or is securely connected thereto, a gearbox input gear wheel 16 which is arranged in a central region 14 and is connected in a rotationally fixed manner to an electric adjustment motor (not shown), and a base plate 18 which is securely connected to the camshaft. The regular non-uniform input torque of an associated internal combustion engine is introduced into the adjustment device 10 via the chain wheel 12, while the adjustment torque of the adjustment motor is introduced into the adjustment device 10 via the gearbox input gear wheel 16.

The adjustment device 10 also includes an emergency running device 20 which is connected in a rotationally fixed manner to the base plate 18 and, in FIG. 1, is secured via an additional circlip 18*a*. This is not shown in the following figures in order to be able to illustrate the principle of operation of the adjustment device 10 more clearly.

Figure 2:
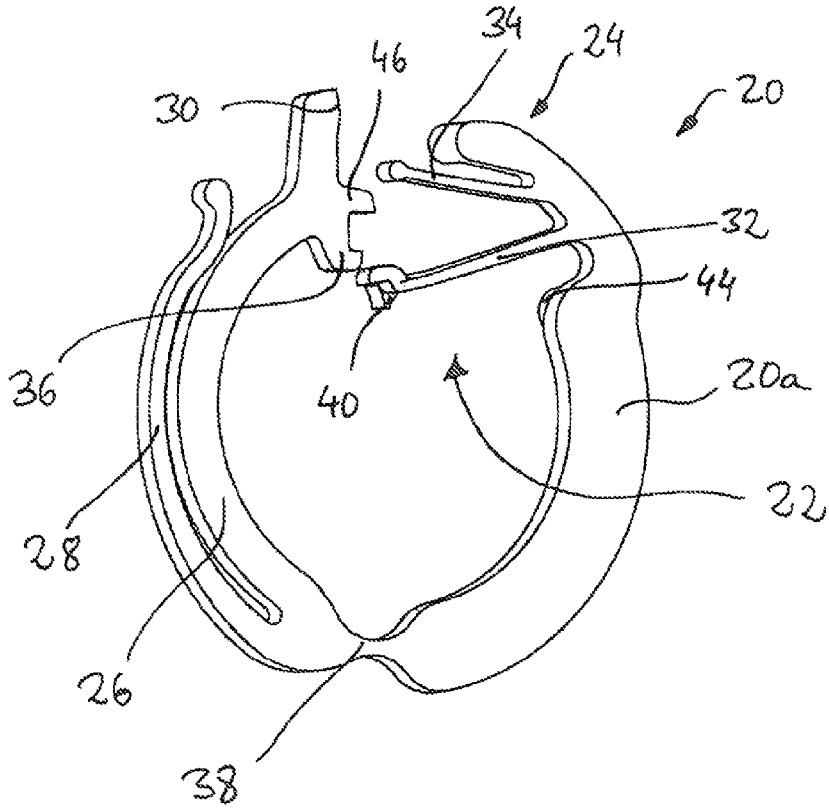
FIG. 2 illustrates an isometric view of the device for emergency operation of the adjustment device of FIG. 1.
Figure 3A:
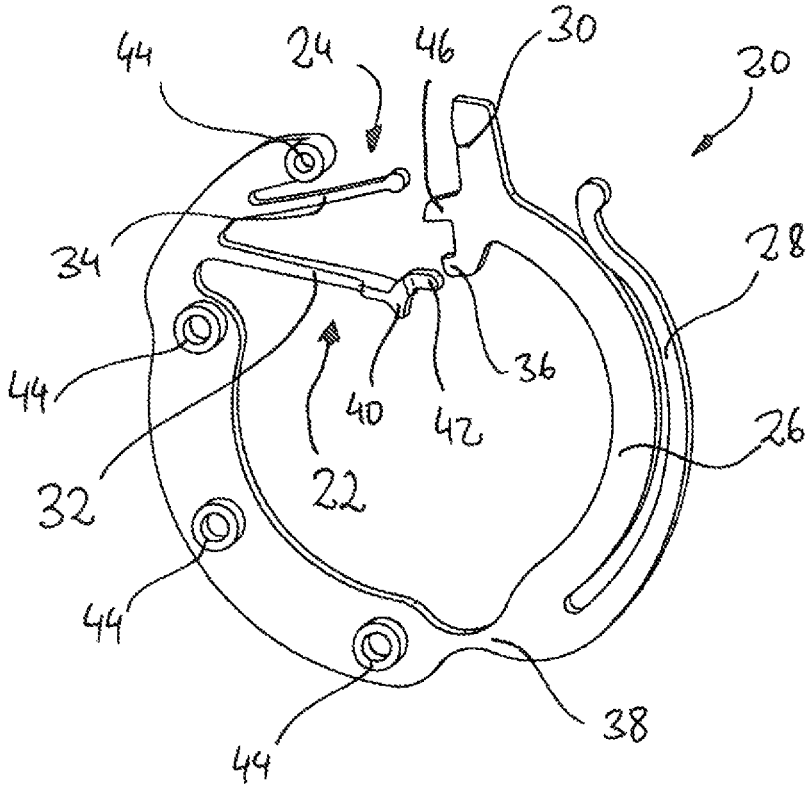
FIGS. 3*a* and 3*b* illustrate the device for emergency operation of the adjustment device in an isometric rear view, in FIG. 3*a* the device for emergency operation is activated, while in FIG. 3*b* it is deactivated.
Figure 3B:
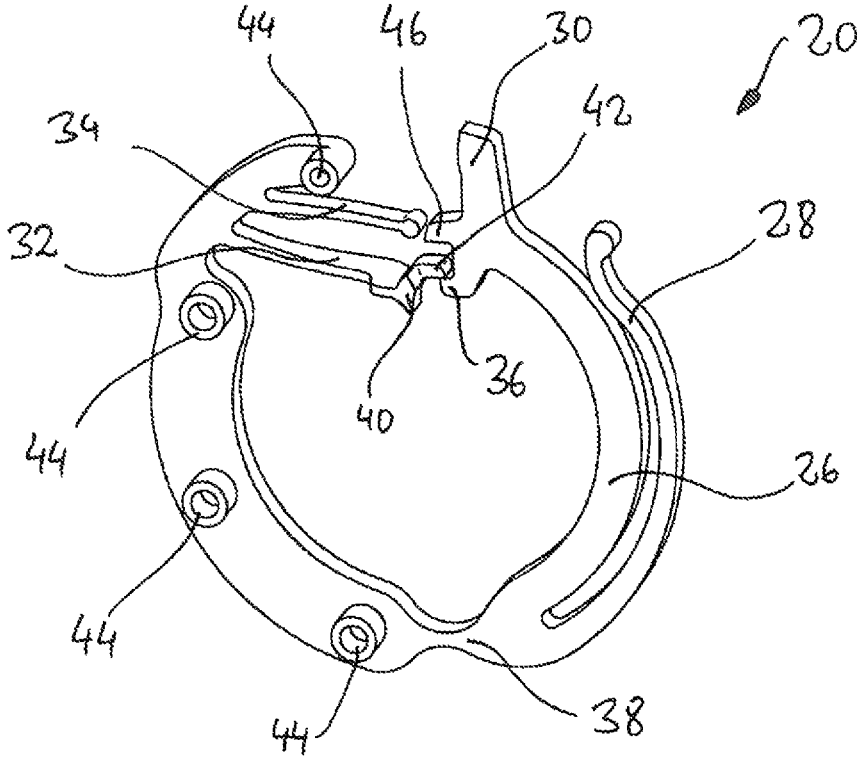

The emergency running device 20, or an integral component of the device 20 for emergency operation of the adjustment device 10, is illustrated in detail in FIGS. 2 to 3*b*. FIG. 2 illustrates an isometric view from the front of the device in FIG. 1. FIGS. 3*a* and 3*b* are isometric views of this component of the emergency running device 20 from the rear.

As well as the component illustrated in FIG. 2, the emergency running device 20 also includes a locking bolt 50, which can be seen, for example, in FIG. 1 and FIGS. 4*a* to 4*c*.

The component of the emergency running device 20 illustrated in FIGS. 2 and 3*a* to 3*b* combines the freewheel device 22 and the locking device 24 of the emergency running device 20. Furthermore, a release lever 26 is provided as an actuator which, in the fitted state, is forced by a spring clip 28 in the direction of a lateral stop 50*a* of the locking bolt 50 (i.e. to the right in FIGS. 1 and 2). The lateral stop 50*a*, which together with lateral stop 50*b* simultaneously forms a guide for the locking bolt 50, is formed on the base plate 18, as is the stop 50*b*. In the fitted state, in its normal position (cf. FIG. 4*a*), the release lever 26 rests against the stop 50*a* of the base plate with a corresponding stop 30.

The freewheel device 22 includes a pawl 32, which at its free end has a catch or latch 40, which in an assembled state projects towards the gearbox input gear 16. The locking device 24 includes a leaf spring 34, which is formed on the component of the emergency running device 20 illustrated in FIG. 2, and the locking bolt 50 (cf. FIG. 1, for example). The leaf spring 34 serves to move the locking bolt 50 from its inactive position (cf. FIG. 4*a*, for example) into its active position (cf. FIG. 4*c*) to enable it to block the base plate 18 against a relative movement with respect to the chain wheel 12. Accordingly, the leaf spring 34 is pre-tensioned in such a way that it forces the locking bolt 50 radially outwards with respect to the center axis M (cf. FIG. 4*a*).

A projection 42, under which a corresponding holding projection 36 engages as long as the freewheel device is deactivated, i.e. the adjustment device is running in normal mode (cf. FIGS. 3*b* and 4), is formed on the pawl 32 at its free end. The projection 42 only releases the free end of the pawl 32 from the holding projection 36 when the freewheel device 22 is activated. The embodiment of a freewheel device 22 shown in the first embodiment includes a pawl 32 designed as a pliable, pre-tensioned beam, which is pre-tensioned in such a way that, in a released state, it is moved radially inwards with respect to the center axis M. In this activated state of the freewheel device 22, the catch or latch 40 of the pawl 32 is therefore able to engage in the external gearing of the gearbox input gear 16 (cf, also FIGS. 4*b* and 4*c*, for example). In this way, the pawl 32 enables the rotary movement of the gearbox input gear 16 in a first direction, while it blocks a rotary movement of the gearbox input gear 16 in the opposite direction.

A locking projection 46 for the locking bolt 50 in normal operation is provided opposite the free end of the leaf spring 34. This engages (as can be seen by way of example in FIG. 4*a*) in a full-width recess 50*c* on the locking bolt 50, in which the free end of the leaf spring 34 is also accommodated. Alternatively or in combination, however, separate recesses can also be provided on the locking bolt 50 for locking by means of the locking projection 46 and for pre-tensioning with the help of the leaf spring 34.

Furthermore, it can be seen in FIGS. 3*a* and 3*b* that fixing projections 44, which serve to provide the rotationally fixed connection of the component to the base plate 18 of the adjustment device 10, are formed on the rear of the single-piece component of the emergency running device 20. It can also be clearly seen that these projections 44 which are used for fixing are not formed on the release lever 26 or the spring clip 28, as the release lever 26 in particular must remain movable relative to the base plate 18 in order to release or activate the freewheel device 22 and/or the locking device 24.

Figure 4A:
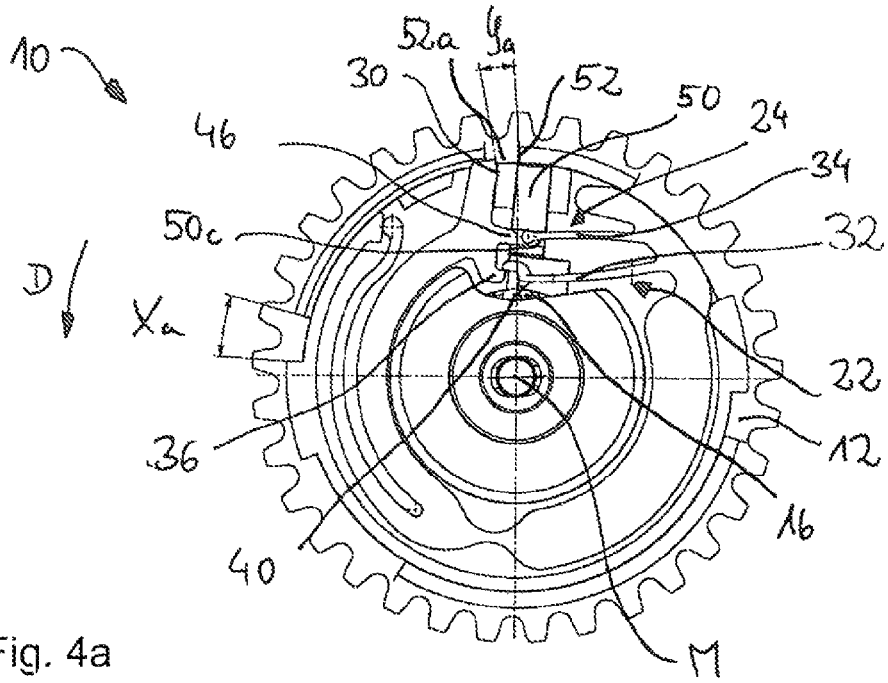
FIGS. 4*a*, 4*b* and 4*c* illustrate the adjustment device of FIG. 1 in a plan view, in FIG. 4*a* the device for emergency operation is not activated, in FIG. 4*b* the device for emergency operation is triggered, and in FIG. 4*c* the device for emergency operation is locked.
Figure 4B:
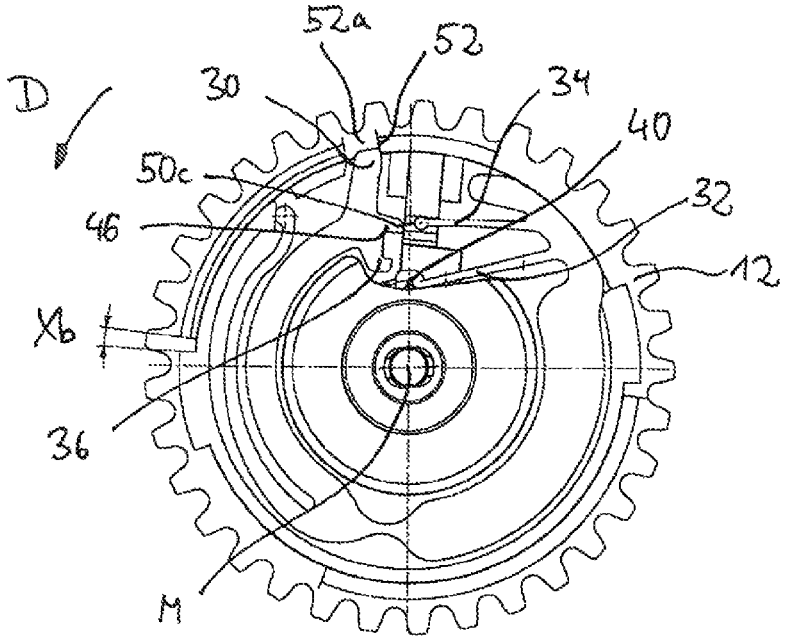
Figure 4C:
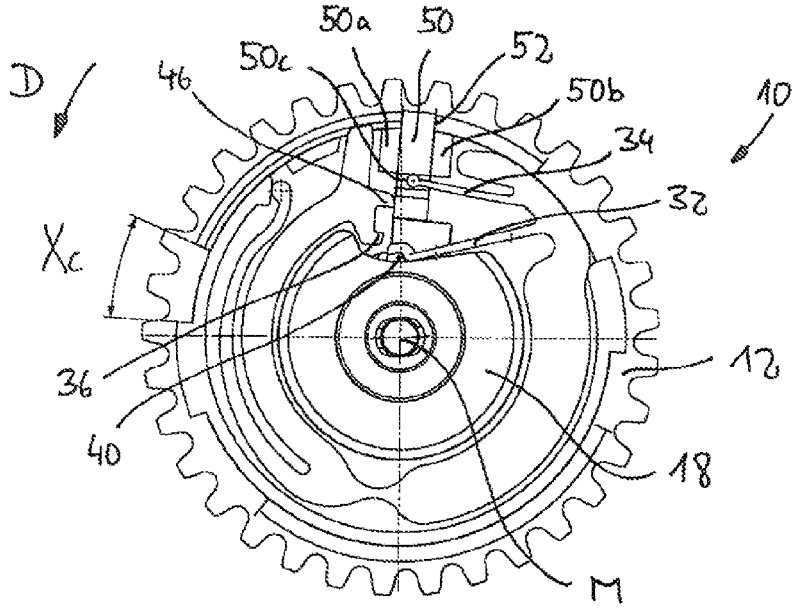

The principle of operation of the present invention is described in more detail below with reference to FIGS. 4*a* to 4*c*. FIG. 4*a* shows the normal operation of the adjustment device 10 in which the freewheel device 22 is deactivated so that the catch or latch 40 does not engage in the external gearing of the gearbox input gear 16. Instead, the projection 42 of the free end of the pawl 32 of the freewheel device 22 is supported on the associated holding projection 36. In addition, the locking projection 46 also engages in the corresponding recess 50*c* of the locking bolt 50 and thus prevents the pre-tensioned leaf spring 34 of the locking device 24 forcing the locking bolt 50 radially outwards.

The adjustment gearbox of the adjustment device 10 shown is a positive gearbox or positive summing gearbox with a positive step-up/step-down ratio, with which the camshaft rotates in the direction indicated by the arrow designated by D. In normal operation, the adjustment motor on the gearbox input gear 16 ensures that the camshaft rotates in a defined phase position with respect to the chain wheel 12. If the adjustment motor fails, for example, then it produces an appropriate braking torque and its speed falls compared with the chain wheel or camshaft drive gear 12. As a result, commensurate with the positive gearbox, the camshaft is reversed, that is to say moved in the "late" direction, i.e. the angle Xa between a stop 54 of the base plate 18 and a stop 48 of the chain wheel 12 is reduced to an angle Xb (cf. FIG. 4*b*).

In doing so, the camshaft is moved beyond the maximum late position in normal operation until the actuator in the form of release lever 26 is tripped. As can be seen in FIG. 4*b*, not only does the angle Xa reduce due to the movement of the camshaft together with the base plate 18 relative to the chain wheel 12 in the "late" direction, but also the angle Ya, wherein this lies between the stop 30 of the release lever 26 and a stop 52 of the chain wheel 12. In the position shown in FIG. 4*b*, the angle Ya has just become zero, that is to say the release lever 26 is just activated, i.e. pushed to the left by the stop 52 of the chain wheel 12. In normal operation of the adjustment device, the spring clip 28 associated with the release lever pushes the release lever 26 to the right until in doing so a radially inner region of the stop 30 comes into contact with the stop 50*a* which is fixed to the base plate 18, so that the position of the stop 30 is defined very accurately with respect to the base plate 18.

The release lever 26 is attached to the emergency running device 20 via an elastic intermediate region 38 of the release lever 26, which at the same time acts in the manner of a hinge point.

The freewheel device 22 is activated due to the slight displacement of the stop 30 of the release lever 26 together with the holding projection 36 and the locking projection 46. The projection 42 of the pawl 32, therefore, releases from the holding projection 36 and, as a result of its elastic pre-tensioning towards the gearbox input gear 16, is displaced radially inwards until the latch or catch 40 engages in the external gearing of the gearbox input gear wheel 16. From now on, as long as the adjustment device 10 is in emergency running mode, the activated freewheel device 22 only allows a forwards movement (in direction of rotation D of the camshaft) of the gearbox input gear wheel 16 with respect to the part, the base plate 18, which is fixed to the camshaft.

As the drive to the camshaft via the camshaft drive gear or chain wheel 12 is non-uniform even in steady-state operation of the internal combustion engine, angular ranges in which the camshaft drive gear or chain wheel 12 is accelerated and angular ranges in which it is decelerated repeatedly occur. In this way, the gearbox input gear wheel 16 together with a rotor of the inactive adjustment motor is also accelerated by the activated freewheel device in the acceleration phase, i.e., the freewheel device takes the gearbox input gear 16 of the adjustment motor with it. In the subsequent deceleration phase of the chain wheel 12, the rotational pulse of the adjustment motor and of the gearbox input gear wheel 16 is sufficiently large to move the gearbox input gear wheel 16 forwards by a small amount with respect to the base plate 18 (i.e., in the direction of rotation D of the camshaft) against any braking torque of the inactive adjustment motor which may be acting. In this way, the camshaft is moved in the direction of its emergency running position.

When this is reached (cf. FIG. 4*c*), the locking bolt 50 is moved radially outwards by the pre-tensioned leaf spring 34 into the now accessible recess 52*a*, as a result of which the chain wheel 12 is locked relative to the base plate 18. The mechanical early stops 70 which are fixed to the base plate 18 and the corresponding early stops 80 which are fixed to the chain wheel 12 can also be seen in FIG. 4*c*. From the angle Xc it can be seen that the present emergency stop position is a defined mid-position of the camshaft.

After the chain wheel 12 has been blocked relative to the base plate 18 with the help of the locking bolt 50, the adjustment device can be pre-tensioned approximately free from play or even totally free from play by a small further forwards movement of the gearbox input gear wheel 16 with respect to the part fixed to the camshaft, i.e. the base plate 18.

Figure 5:
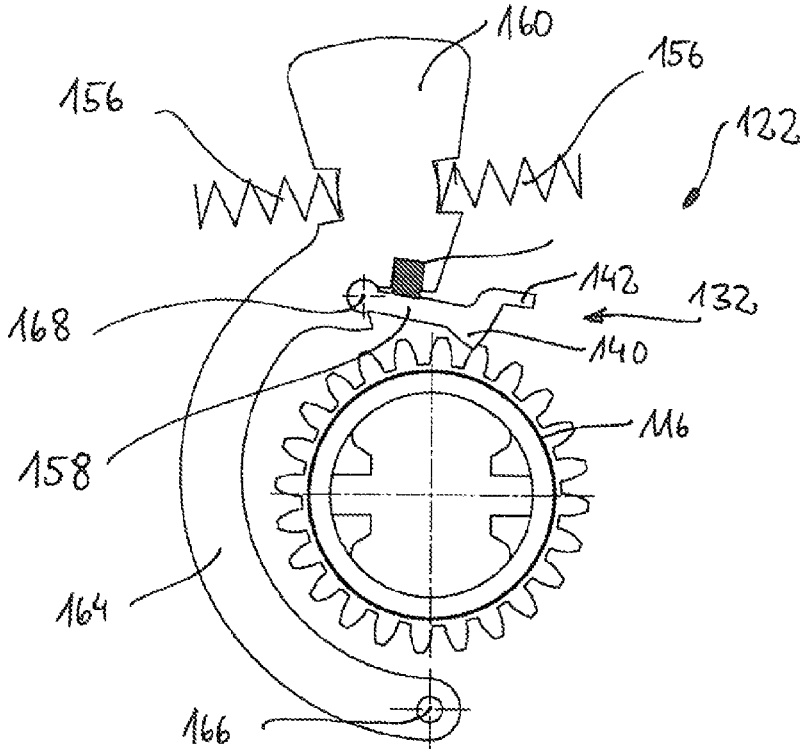
FIG. 5 illustrates the adjustment device in accordance with a second embodiment of the invention.

Finally, a further embodiment of the freewheel device, which in FIG. 5 is allocated the reference 122, is illustrated in FIG. 5. The same features are allocated the same references in the two embodiments of the invention, wherein however the number "1" is placed before the reference in the second embodiment of FIG. 5.

In the embodiment shown in FIG. 5, as well as the pawl 132, the freewheel device 22 includes an additional rocker arm 160. At the same time, the pawl 132 is flexibly mounted in the pivot point 168 on the rocker arm 160 by means of a swivel arm 158. Furthermore, the pawl 132 is pre-tensioned towards the gearbox input gear 116 by an additional spring 162, wherein the spring is likewise supported on the rocker arm 160.

The remaining components of the adjustment device are omitted in order to simplify the view. However, the rocker arm 160 is likewise rotatably flexibly mounted with respect to a pivot point 166 on the base plate (not shown in FIG. 5) of the adjustment device and spring-loaded via two resilient elements 156.

The spring elements 156 can likewise be supported by their other end in each case, for example on the base plate of the adjustment device. The rocker arm 160 is held in a nominal angular position and can also be locked by the two spring elements 156. In emergency mode or emergency running of the locking device, such a lock is then released, and at a certain speed excitation of the camshaft drive the arm resonates and thus produces a particularly high force in order to move the camshaft towards the emergency position. At the same time, the resonant frequency can be adjusted by way of the spring elements 156, such that these can be designed so that said frequency is reached during the engine start-up of the internal combustion engine, i.e., by the starter of the internal combustion engine.

Although embodiments have been described herein, it should be understood that numerous other modifications and embodiments can be devised by those skilled in the all that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An adjustment device configured to adjust the relative angular position of a camshaft with respect to a crankshaft within a predetermined angle range, the adjustment device comprising:

an emergency device including a freewheel device configured for activation in an emergency mode of the adjustment device to permit an adjustment movement of the camshaft with respect to the crankshaft from a first position in a first direction towards a second, emergency running position and to block an adjustment movement in a second direction opposite thereto; and an adjustment gearbox having a gear element, wherein the freewheel device includes a spring-pretensioned pawl configured to engage in an interlocking manner the gear element of the adjustment gearbox.

2. The adjustment device of claim 1, wherein the freewheel device is securely connected directly to the camshaft.

3. The adjustment device of claim 1, wherein the freewheel device is securely connected indirectly to the camshaft.

4. The adjustment device of claim 1, wherein the gear element comprises a higher ratio gear element.

5. The adjustment device of claim 1, wherein the gear element comprises a gearbox input gear wheel.

6. The adjustment device of claim 1, wherein the emergency device comprises an actuator configured to activate the freewheel device.

7. The adjustment device of claim 6, wherein the actuator comprises an end limit switch which is arranged outside an adjustment range of the camshaft relative to the crankshaft in normal operation of the adjustment device.

8. The adjustment device of claim 6, further comprising a base plate and an input drive gear.

9. The adjustment device of claim 8, wherein the actuator is fixed to one of the base plate and the input drive gear, such that in normal operation of the adjustment device, the end limit switch of the actuator is resiliently supported on a stop of one of the base plate (18) and the input drive gear.

10. An adjustment device configured to adjust the relative angular position of a camshaft with respect to a crankshaft within a predetermined angle range, the adjustment device comprising:

an emergency device including a freewheel device configured for activation in an emergency mode of the adjustment device to permit an adjustment movement of the camshaft with respect to the crankshaft from a first position in a first direction towards a second, emergency running position and to block an adjustment movement in a second direction opposite thereto, the emergency device including a locking device configured to lock the adjustment device when the camshaft has reached an emergency running position relative to the crankshaft and an actuator configured to activate the freewheel device, wherein the locking device includes a locking bolt configured to act between an input drive gear of the camshaft and a component which is fixed to the camshaft.

11. The adjustment device of claim 10, wherein the locking device includes an elastic element configured to pre-tension the locking bolt in a direction of its locking position.

12. The adjustment device of claim 10, wherein the locking device includes a leaf spring configured to pre-tension the locking bolt in a direction of its locking position.

13. The adjustment device of claim 10, wherein the freewheel device and the locking device are designed integrally with one another.

14. The adjustment device of claim 10, wherein the actuator is configured to activate the freewheel device and the locking device.

15. The adjustment device of claim 10, wherein the freewheel device has a rocker arm.

16. The adjustment device of claim 10, wherein the actuator comprises an end limit switch which is arranged outside an adjustment range of the camshaft relative to the crankshaft in normal operation of the adjustment device.

17. The adjustment device of claim 10, wherein the freewheel device comprises a spring-pretensioned pawl configured to engage in an interlocking manner the gear element of the adjustment gearbox.

18. An adjustment device configured to adjust the relative angular position of a camshaft with respect to a crankshaft within a predetermined angle range, the adjustment device comprising:

an emergency device including a freewheel device having a rocker arm and which is configured for activation in an emergency mode of the adjustment device to permit an adjustment movement of the camshaft with respect to the crankshaft from a first position in a first direction towards a second, emergency running position and to block an adjustment movement in a second direction opposite thereto.

* * * * *